US008056994B2

(12) United States Patent
Chen et al.

(10) Patent No.: US 8,056,994 B2
(45) Date of Patent: Nov. 15, 2011

(54) POSITIONING DEVICE FOR A DRAWER

(75) Inventors: Ken-Ching Chen, Kaohsiung Hsien (TW); Hsiu-Chiang Liang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 557 days.

(21) Appl. No.: 12/232,832

(22) Filed: Sep. 25, 2008

(65) Prior Publication Data

US 2009/0261700 A1 Oct. 22, 2009

(30) Foreign Application Priority Data

Apr. 18, 2008 (TW) ..... 97114404 A

(51) Int. Cl.
*A47B 88/12* (2006.01)

(52) U.S. Cl. ..... 312/334.6; 312/334.14

(58) Field of Classification Search ..... 312/334.6, 312/348.1, 348.2, 333, 334.14, 334.27, 334.5; 384/21, 22; 292/80, 81, 85, 87, 194, 195, 292/200, DIG. 11, DIG. 38, DIG. 36, DIG. 37; 16/429; 49/147, 394; 24/704.1
See application file for complete search history.

(56) References Cited

U.S. PATENT DOCUMENTS 86,686 A * 2/1869 Peterson ..... 292/121
1,535,403 A * 4/1925 Ellison ..... 292/18
2,304,145 A * 12/1942 Borchers ..... 292/336.3
2,337,894 A * 12/1943 Jacobi ..... 292/227
3,161,923 A * 12/1964 Crain ..... 292/128
3,208,781 A * 9/1965 Appleberry ..... 292/128
3,226,790 A * 1/1966 Brown ..... 24/67.5
3,767,244 A * 10/1973 Plaw ..... 292/227
3,914,831 A * 10/1975 Steinberg ..... 24/265 AL
3,918,754 A * 11/1975 Isbister ..... 292/224
4,416,477 A * 11/1983 Bialobrzeski et al. ..... 292/19
4,473,262 A * 9/1984 Staye ..... 312/333
4,542,924 A * 9/1985 Brown et al. ..... 292/87
4,565,916 A * 1/1986 Tsuji et al. ..... 219/225
4,903,451 A * 2/1990 Gresswell ..... 52/584.1
5,261,737 A * 11/1993 Faust et al. ..... 312/334.46
5,281,021 A * 1/1994 Rock et al. ..... 312/334.32
5,403,064 A * 4/1995 Mahler et al. ..... 296/214
5,439,283 A * 8/1995 Schroder et al. ..... 312/334.4
5,560,082 A * 10/1996 Vetter ..... 16/429
5,580,139 A * 12/1996 Grabher ..... 312/333
5,588,729 A * 12/1996 Berger ..... 312/334.4
5,632,541 A * 5/1997 Uthoff ..... 312/333
5,868,478 A * 2/1999 Yemini ..... 312/332.1
(Continued)

*Primary Examiner* — Darnell Jayne
*Assistant Examiner* — Sasha T Varghese
(74) *Attorney, Agent, or Firm* — Rosenberg, Klein & Lee

(57) ABSTRACT

A positioning device for a drawer includes a base, a handle and a pair of connecting members. The base comprises a fixing plate, an engaging arm and a resilient member. The engaging arm comprises a tenon, a first side, a second side opposite to the first side, a first end connected to the fixing plate, and a second end connected to the resilient member. The tenon is disposed on the first side of the engaging arm adjacent to the second end. The second end of the engaging arm is formed with a first through hole. The handle is formed with a second through hole corresponding in position to the second end of the engagement arm. The handle is provided with a recess to accommodate the resilient member. The connecting members insert through the second through hole and the first through hole. By assembling the above parts with the drawer, the tenon engages with an engaging hole of the drawer slide.

9 Claims, 6 Drawing Sheets

U.S. PATENT DOCUMENTS

| | | | | |
|---|---|---|---|---|
| 6,296,338 | B1 * | 10/2001 | Stijns | 312/333 |
| 6,450,063 | B1 * | 9/2002 | Harvey et al. | 74/547 |
| 6,454,371 | B1 * | 9/2002 | Muterthies et al. | 312/263 |
| 6,547,289 | B1 * | 4/2003 | Greenheck et al. | 292/126 |
| 6,913,334 | B2 * | 7/2005 | Weichelt | 312/334.4 |
| 6,945,618 | B2 | 9/2005 | Kim et al. | |
| 7,194,930 | B2 * | 3/2007 | Dawson | 74/547 |
| 7,201,411 | B2 * | 4/2007 | Bella et al. | 292/336.3 |
| 7,226,139 | B2 | 6/2007 | Salice | |
| 7,251,860 | B2 * | 8/2007 | Liang et al. | 16/429 |
| 7,690,091 | B2 * | 4/2010 | Stobbe | 24/704.1 |
| 2004/0095047 | A1 * | 5/2004 | Salice | 312/332.1 |
| 2004/0227440 | A1 * | 11/2004 | Booker et al. | 312/334.1 |
| 2005/0231083 | A1 * | 10/2005 | Garcie | 312/333 |
| 2007/0046158 | A1 * | 3/2007 | Hoffman | 312/333 |
| 2008/0122333 | A1 * | 5/2008 | Tseng et al. | 312/333 |
| 2008/0218045 | A1 * | 9/2008 | Moser | 312/333 |
| 2008/0303397 | A1 * | 12/2008 | Chen et al. | 312/334.46 |

* cited by examiner

POSITIONING DEVICE FOR A DRAWER

BACKGROUND OF THE INVENTION

1. Field of the Invention

The present invention relates to a positioning device for a drawer, and more particularly to a positioning device that is applied to an undermount drawer slide and a drawer, without a tool to mount or to dismount the drawer.

2. Description of the Prior Art

The connecting means of a conventional design for a drawer with an undermounted drawer slide requires a fastener to complete the assembly. A recent design has a quick-release device to mount and to dismount the drawer. The drawer slide has a hole corresponding to the quick-release device so as to position the drawer. There are a few patented devices on the market, such as U.S. Pat. Nos. 5,261,737, 5,439,283, 5,580,139, 5,632,541, 6,454,371, 6,913,334 B2, 6,945,618 B2, and 7,226,139 B2, and US Patent Application Publication Nos. 2004/0095047, 2004/0227440, and 2005/0231083, which disclose a quick-release device and a fixing means.

The present invention conforms to Eco, Ecology and Economy design.

SUMMARY OF THE INVENTION

According to one aspect of the present invention is to provide a positioning device for a drawer that is able to quickly assemble and disassemble the parts, conforming to the criteria of environmental protection.

To achieve the above aspect, the present invention comprises a base, a handle, and a pair of connecting members. The base comprises a fixing plate, an engaging arm and a resilient member. The engagement arm comprises a first side, a second side opposite to the first side, a first end, a second end opposite to the first end, and a tenon. The first end is connected to the fixing plate, while the second side adjacent to the second end is connected to the resilient member. The second end is formed with a first through hole and a groove. The tenon is disposed on the first side. The handle is formed with a second through hole corresponding in position to the second end of the engagement arm. The connecting members are inserted through the second through hole and the first through hole of the second end. The handle comprises a pair of supporting portions, a pair of upper and lower sides, a grasping side, and a recess for accommodating the resilient member therein. The resilient member has one end engaging with the recess such that a resilient force exerted by the resilient member is applied against the handle. When the above-mentioned parts are coupled with the drawer, the tenon will engage with a drawer slide. When the handle is pressed, the supporting portions will function as a fulcrum to disengage the tenon from the drawer slide so that the drawer is disassembled quickly.

Each connecting member comprises a head and a connecting portion. The head is provided with a projection at one side thereof. The connecting portion comprises a hook at one end thereof.

The pair of connecting members is inserted through the second through hole of the handle and the first through hole of the second end of the engagement arm, with the projections engaging with the groove of the second end and the hooks engaging with each other.

The supporting portion is formed with an angle at one side of the handle.

The drawer slide has an engaging hole for the tenon of the engagement arm of the base to insert therein for securing purpose.

According to another aspect of the present invention is to provide a positioning device for a drawer, which comprises a base with an engagement arm connected with a handle by means of a pair of connecting members for quick assembly and disassembly.

According to yet another aspect of the present invention is to provide a positioning device for a drawer, which is able to disassemble the connecting members so that it is convenient to disassemble, replace or maintenance the parts.

DETAILED DESCRIPTION OF THE PREFERRED EMBODIMENT

Figure 1:
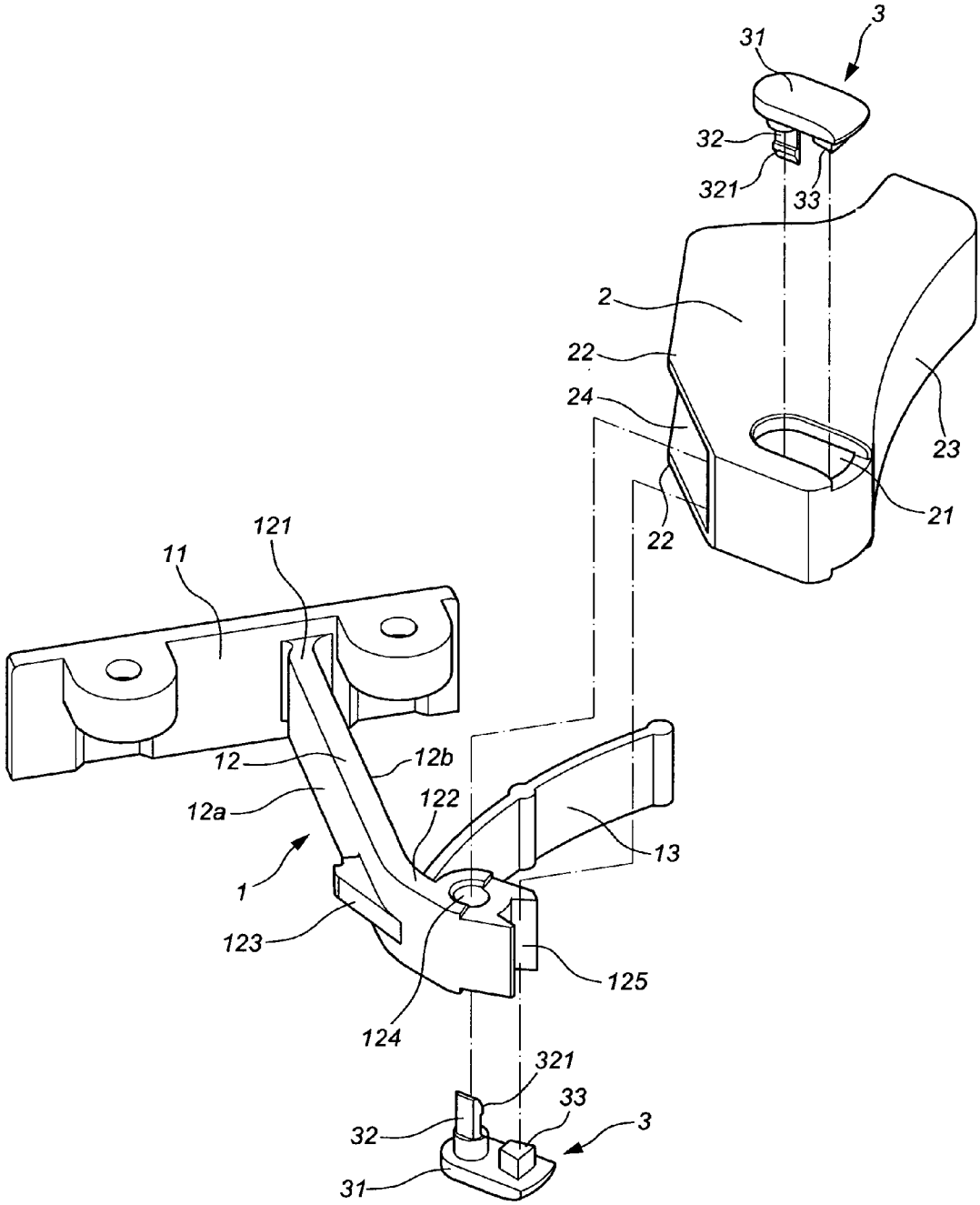
FIG. 1 is an exploded view of a preferred embodiment of the present invention.

Referring to FIG. 1, it depicts an exploded view in accordance with a preferred embodiment of the present invention which comprises a base 1, a handle 2, and a pair of connecting members 3.

The base 1 comprises a fixing plate 11, an engagement arm 12, and a resilient member 13. The fixing plate 11 is adapted to be fixed to a drawer. The engagement arm 12 comprises a first side 12*a*, a second side 12*b* opposite to the first side 12*a*, a first end 121 and a second end 122 opposite to the first end 121. The first end 121 is connected to the fixing plate 11, while the second side 12*b* adjacent to the second end 122 is connected to the resilient member 13. A tenon 123 is provided between the first end 121 and the second end 122. In this embodiment, the tenon 123 is disposed on the first side 12*a* of the engagement arm 12 adjacent to the second end 122. The second end 122 is formed with a first through hole 124 and a groove 125.

The handle 2 is formed with a second through hole 21 corresponding in position to the second end 122 of the engagement arm 12. The handle 2 comprises a pair of supporting portions 22, a pair of upper and lower sides, a grasping side 23, and a recess 24 adapted to receive the resilient member 13 therein. The supporting portions 22 are the edges of the upper and lower sides of the handle 2. Each of the supporting portions 22 is formed with an angle. One end of the resilient member 13 engages with the bottom of the recess 24 such that a resilient force exerted by the resilient member is applied against the handle 2.

Each connecting member 3 comprises a head 31 and a connecting portion 32. The head 31 is provided with a projection 33 at one side thereof. The connecting portion 32 comprises a hook 321 at one end thereof. The pair of connecting members 3 is symmetrical.

Figure 2:
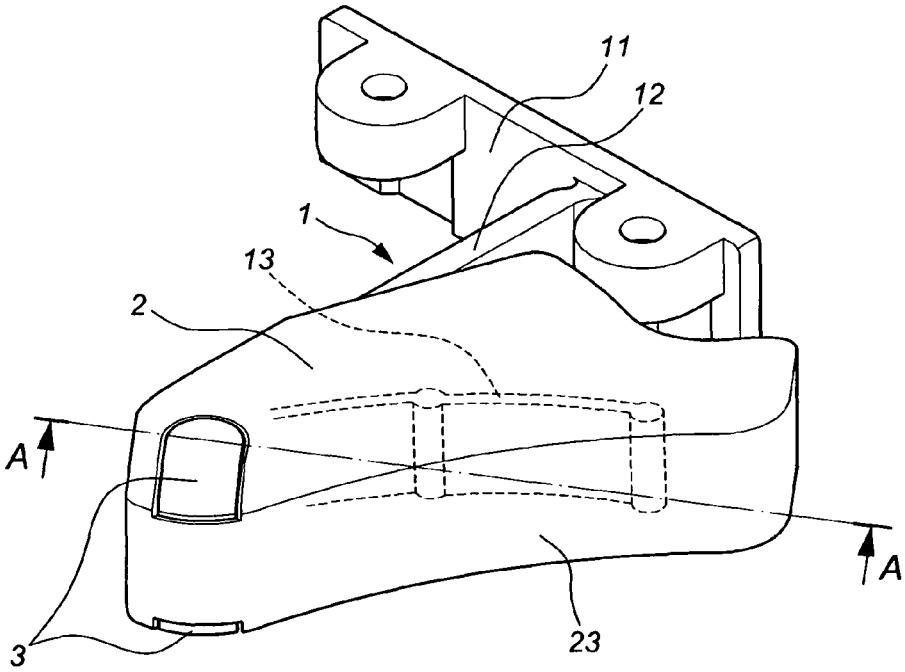
FIG. 2 is a perspective view of the preferred embodiment of the present invention.
Figure 3:
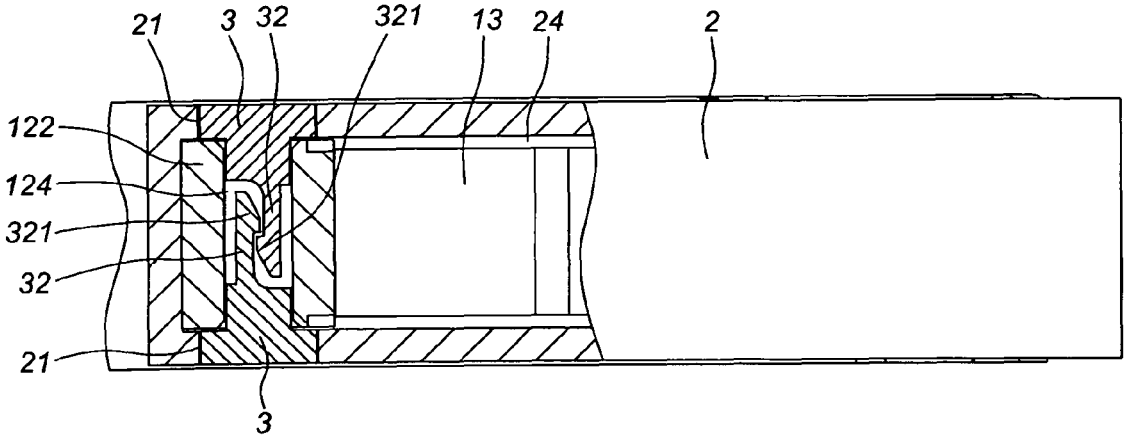
FIG. 3 is a cross-sectional view taken along line A-A of FIG. 2 showing the engagement of connecting members.

FIGS. 2 and 3 depict an assembly in accordance with the preferred embodiment of the present invention. The engagement arm 12 and the resilient member 13 of the base 1 are accommodated in the handle 2. The connecting portions 32 of the connecting members 3 are inserted through the second through hole 21 of the handle 2 and the first through hole 124 of the second end 122 of the engagement arm 12, with the hooks 321 engaging with each other. The projections 33 of the connecting member 3 engage with the groove 125 of the second end 122 of the engagement arm 12.

Figure 4:
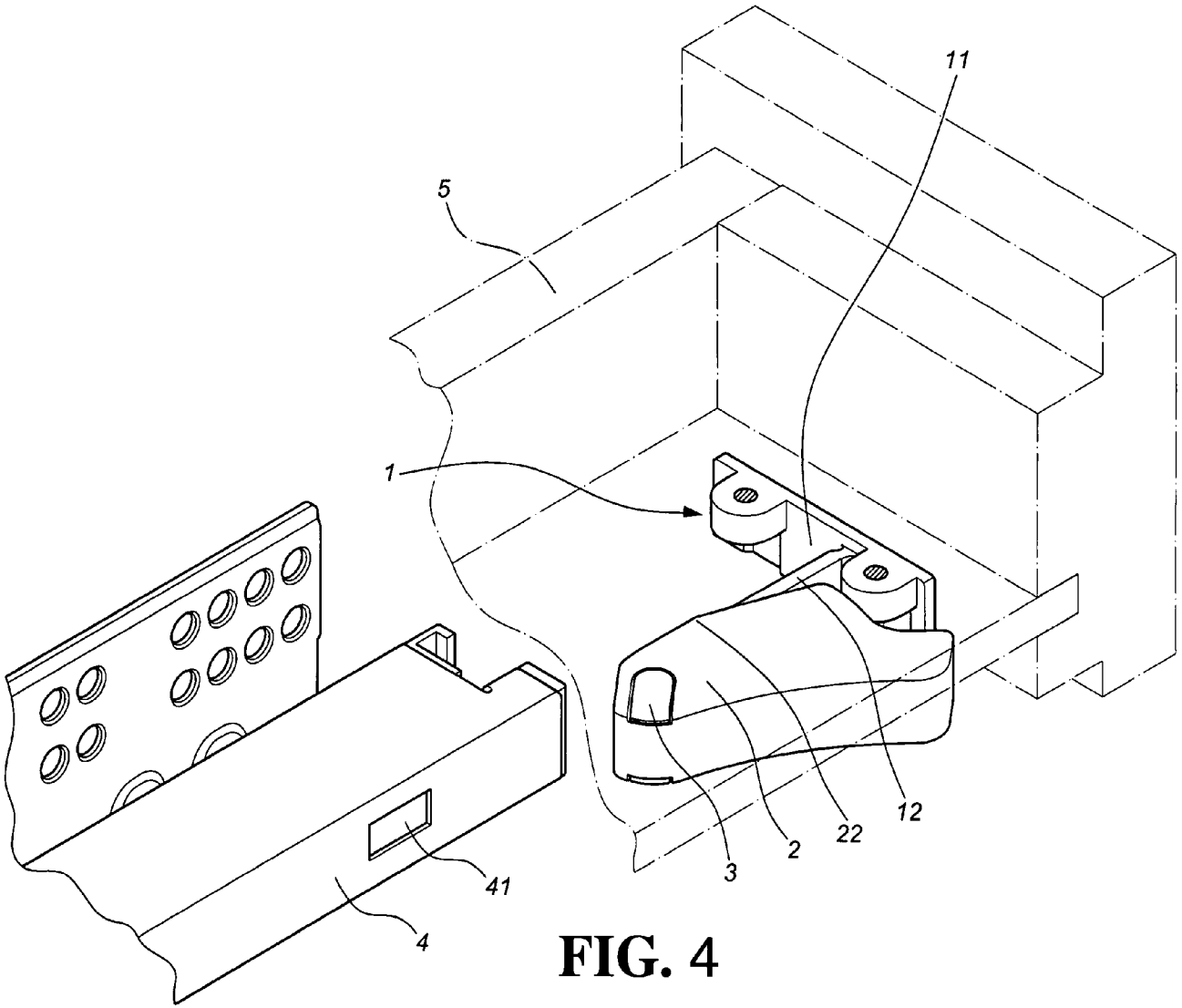
FIG. 4 is an exploded view of the preferred embodiment of the present invention incorporating with a drawer and a drawer slide.
Figure 6:
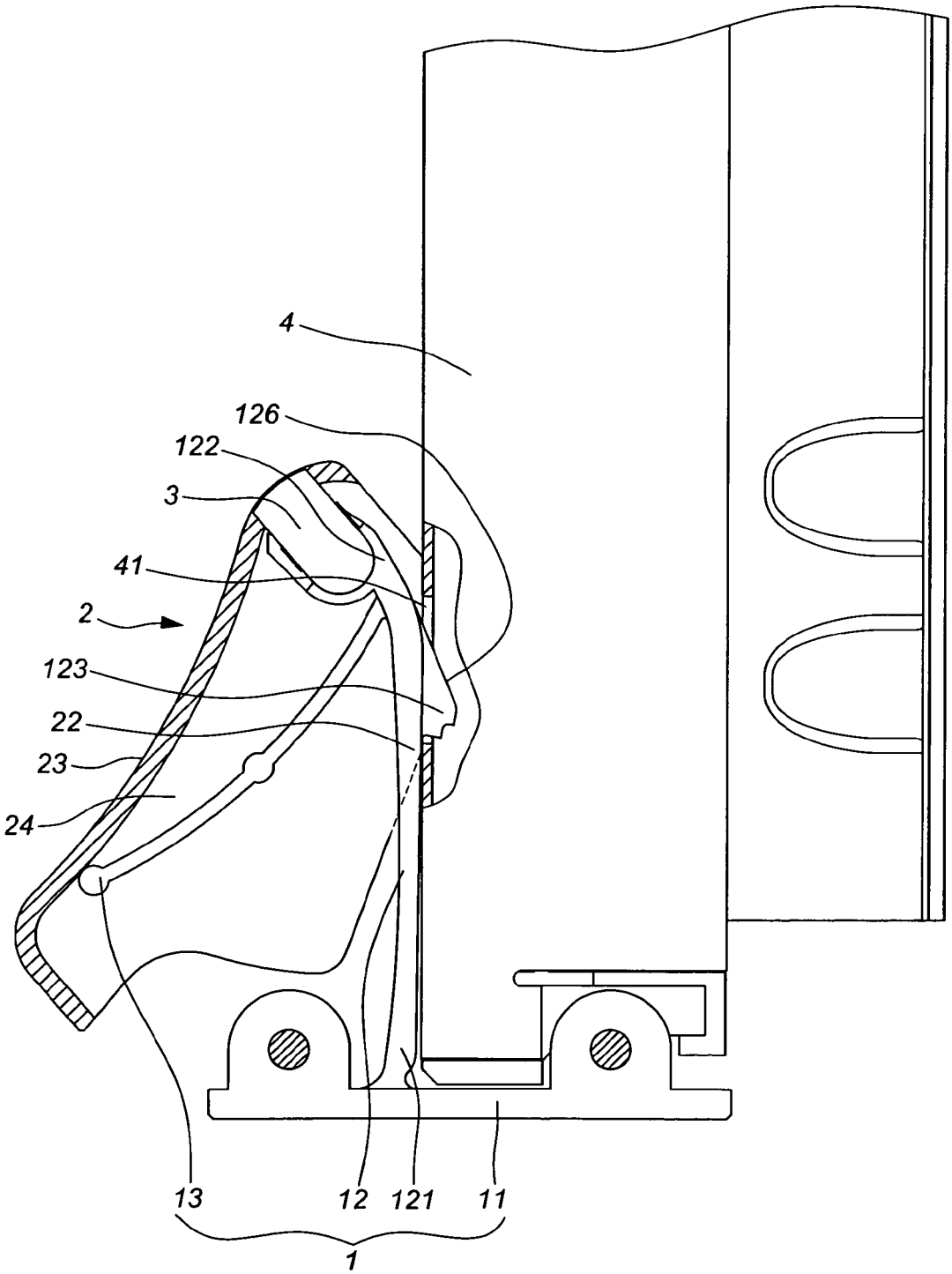
FIG. 6 is a cross-sectional view of the preferred embodiment of the present invention showing a tenon engaging with an engaging hole of the drawer slide.

FIG. 4 depicts an exploded view of the preferred embodiment of the present invention incorporating with a drawer slide 4 and a drawer 5. The drawer 5 has a bottom and the drawer slide 4 has an engaging hole 41 for the tenon 123 to be positioned therein, as shown in FIG. 6. The base 1 is disposed on the bottom of the drawer 5, and the fixing plate 11 is fixed on the bottom of the drawer 5. When the drawer 5 is placed onto the drawer slide 4 and pushed inwardly, the tenon 123 will engage with the engaging hole 41 automatically, without pulling the handle 2.

Figure 5:
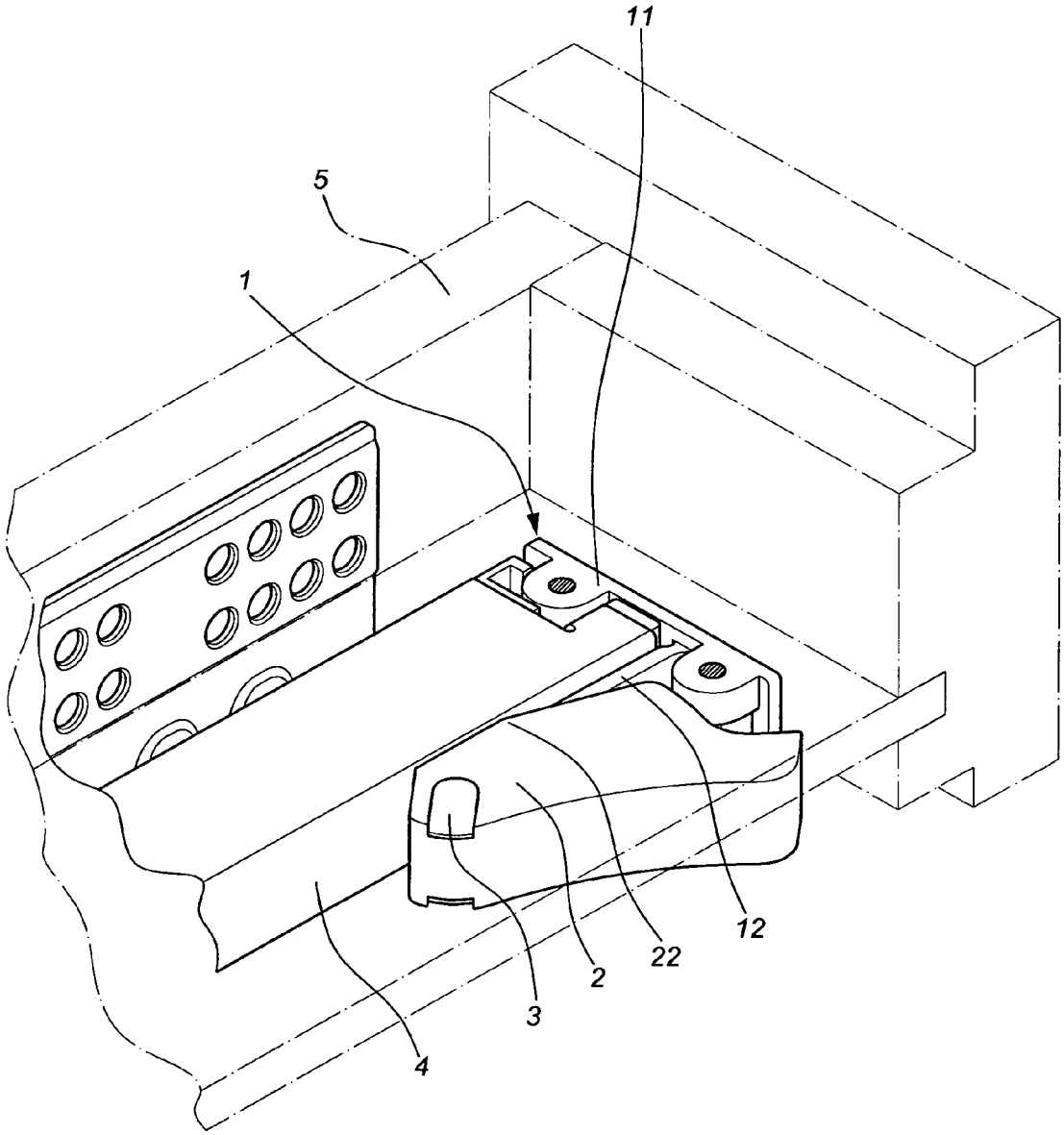
FIG. 5 is a perspective view of the preferred embodiment of the present invention incorporating with the drawer and the drawer slide.

FIG. 5 depicts an assembled view of the preferred embodiment of the present invention incorporating with the drawer 5 and the drawer slide 4. The engagement arm 12 of the base 1 is located at one side of the drawer slide 4 after the drawer slide 4 is assembled with the drawer 5, with the supporting portions 22 of the handle 2 against the side of the drawer slide 4.

FIG. 6 depicts a cross-sectional view of the preferred embodiment of the present invention showing the tenon 123 engaging with the engaging hole 41 of the drawer slide 4. The resilient member 13 engages with the bottom of the recess 24 of the handle 2 with the resilient force of the resilient member 13 corresponding to the grasping side 23 to maintain the handle 2 having an outward resilience and the supporting portions 22 against the drawer slide 4. The tenon 123 is inserted into the engaging hole 41 of the drawer slide 4.

Figure 7:
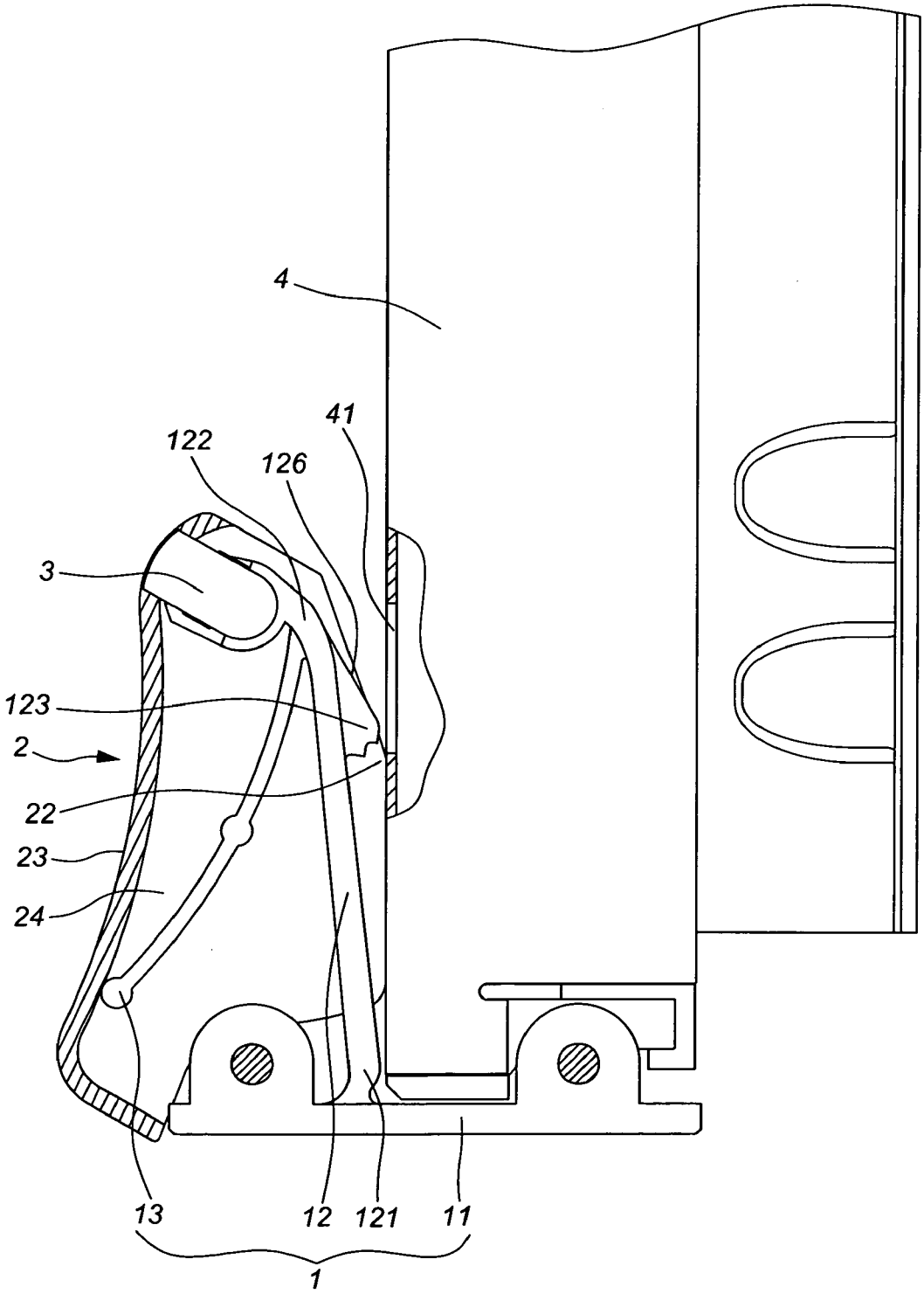
FIG. 7 is a cross-sectional view of the preferred embodiment of the present invention showing the tenon disengaging from the engaging hole of the drawer slide.

FIG. 7 depicts a cross-sectional view of the preferred embodiment of the present invention showing the tenon 123 disengaging from the engaging hole 41 of the drawer slide 4. The grasping side 23 of the handle 2 is pressed to force the supporting portions 22 against the drawer slide 4 as a fulcrum and the engagement arm 12 is forced to bend, which allows the tenon 123 to disengage from the engaging hole 41 of the drawer slide 4 so that the drawer 5 is free to be pulled away.

When the pressing force against the grasping side 23 of the handle 2 is released, the resilience of the resilient member 13 will return and correspond to the grasping side 23 to maintain the handle 2 having an outward resilience and the supporting portions 22 against the drawer slide 4. To assemble the drawer 5 and the drawer slide 4, it is simple to push the drawer 5 towards the drawer slide 4. The tenon 123 has a guiding surface 126 to facilitate sliding into the engaging hole 41 of the drawer slide 4.

What is claimed is:

1. A positioning device for a drawer, the drawer comprising a drawer slide having an engaging hole and a bottom, the positioning device comprising:

a base comprising a fixing plate, an engagement arm and a resilient member, said fixing plate being fixed to the bottom of the drawer, said engagement arm comprising a tenon, a first side, a second side opposite to the first side, a first end and a second end opposite to said first end, said first end being connected to said fixing plate and said second side adjacent to the second end being connected to said resilient member, said tenon being disposed on the first side, and said tenon engaging with the engaging hole of the drawer slide when the drawer slide is assembled with the drawer, said engagement arm having a first through hole at said second end;

a handle having a second through hole corresponding in position to said second end of said engagement arm and a recess for accommodating said resilient member therein, said handle comprising a supporting portion at one side to engage with the drawer slide to function as a fulcrum, said resilient member having one end engaging with said recess such that a resilient force exerted by said resilient member is applied against said handle; and a pair of connecting members inserted through said second through hole of said handle and said first through hole of said second end of said engagement arm so that said handle and said base are connected securely.

2. The positioning device for a drawer as claimed in claim 1, wherein said connecting members are symmetrical, each said connecting member comprising a head and a connecting portion, said connecting portion comprising a hook at one end thereof, the pair of connecting members engaging with each other by means of said hooks.

3. The positioning device for a drawer as claimed in claim 1, wherein said tenon is disposed on the first side of said engagement arm adjacent to said second end of said engagement arm.

4. The positioning device for a drawer as claimed in claim 1, wherein said supporting portion is formed with an angle.

5. The positioning device for a drawer as claimed in claim 1, wherein said engagement arm of said base further comprises a groove, and each said connecting member further comprises a projection to engage with said groove of said engagement arm.

6. A positioning device, comprising:

a base comprising a fixing plate, an engagement arm, and a resilient member, said engagement arm comprising a tenon, a first side, a second side opposite to the first side, a first end and a second end opposite to said first end, said first end being connected to said fixing plate and said second side adjacent to the second end being connected to said resilient member, said tenon being disposed on the first side, said engagement arm having a first through hole at said second end;

a handle having a second through hole corresponding in position to said second end of said engagement arm and a recess for accommodating said resilient member therein, said handle comprising a supporting portion at one side to function as a fulcrum, said resilient member having one end engaging with said recess such that a resilient force exerted by said resilient member is applied against said handle; and a pair of connecting members inserted through said second through hole of said handle and said first through hole of said second end of said engagement arm so that said handle and said base are connected securely;

wherein said engagement arm of said base further comprises a groove, and each said connecting member further comprises a projection to engage with said groove of said engagement arm.

7. The positioning device as claimed in claim 6, wherein said connecting members are symmetrical, each said connecting member comprising a head and a connecting portion, said connecting portion comprising a hook at one end thereof, the pair of connecting members engaging with each other by means of said hooks.

8. The positioning device as claimed in claim 6, wherein said tenon is disposed on the first side of said engagement arm adjacent to said second end of said engagement arm.

9. The positioning device as claimed in claim 6, wherein said supporting portion is formed with an angle.

* * * * *